US005515603A

United States Patent [19]

Ziemek et al.

[11] Patent Number: 5,515,603

[45] Date of Patent: May 14, 1996

[54] METHOD FOR MANUFACTURING A COAXIAL CABLE

[75] Inventors: Gerhard Ziemek, Langenhagen; Harry Staschewski, both of Langenhagen, Germany

[73] Assignee: Kabelmetal electro GmbH, Hannover, Germany

[21] Appl. No.: 345,301

[22] Filed: Nov. 28, 1994

[51] Int. Cl.[6] ..... H01B 13/20

[52] U.S. Cl. ..... 29/828; 29/728; 174/36; 174/107

[58] Field of Search ..... 29/828, 728; 174/36, 174/107

[56] References Cited

U.S. PATENT DOCUMENTS

| | | | |
|---|---|---|---|
| 2,156,934 | 5/1939 | Barrett | 29/828 X |
| 3,315,025 | 4/1967 | Tomlinson . | |
| 3,356,790 | 12/1967 | Polizzano et al. | 29/828 X |
| 3,397,442 | 8/1968 | McGean | 29/728 X |
| 3,405,228 | 10/1968 | Polizzano . | |
| 3,553,811 | 1/1971 | Garner | 29/828 X |
| 3,567,846 | 3/1971 | Brorein | 29/828 X |
| 3,569,610 | 3/1971 | Garner et al. | 29/828 X |
| 3,633,261 | 1/1972 | Grabe | 29/728 X |
| 3,693,250 | 9/1972 | Brorein et al. | 29/728 X |
| 3,703,034 | 11/1972 | Eilhardt et al. | 29/828 |
| 3,824,330 | 7/1974 | Lang | 174/107 X |
| 3,874,076 | 4/1975 | Tsukamoto et al. | 29/828 |
| 4,083,484 | 4/1978 | Pollizzano et al. | 29/828 X |
| 5,109,599 | 5/1992 | Ohihaber | 29/828 |
| 5,212,350 | 5/1993 | Gebs | 174/36 X |
| 5,271,149 | 12/1993 | Maddock | 29/828 |

FOREIGN PATENT DOCUMENTS

| | | | |
|---|---|---|---|
| 2440062 | 5/1980 | France . | |
| 1086314 | 8/1960 | Germany . | |
| 1640194 | 5/1970 | Germany . | |
| 2628946 | 12/1977 | Germany | 29/828 |
| 0496231 | 7/1992 | Germany . | |
| 791513 | 3/1953 | United Kingdom . | |
| 1299964 | 12/1972 | United Kingdom | 29/828 |
| 1441870 | 7/1976 | United Kingdom | 29/828 |

*Primary Examiner*—Carl J. Arbes

*Attorney, Agent, or Firm*—Ware, Fressola, Van Der Sluys & Adolphson

[57] ABSTRACT

A method for manufacturing a coaxial cable is described, whereby a dielectric layer (2) is extruded over an inner conductor (1), a lengthwise incoming metal strip (3) is formed into a tube, having a lengthwise slot around the insulated conductor (1, 2). The tube (3) is welded along the slot to thereby form a welded seam (4), and the welded tube is drawn down onto the surface of the dielectric layer (2). A metal strip (3*a*) having a plastic coating (3*b*) at least on one of its major surfaces is used to form the tube (3), and its lengthwise edges are welded by a laser (19).

21 Claims, 3 Drawing Sheets

METHOD FOR MANUFACTURING A COAXIAL CABLE

BACKGROUND OF THE INVENTION

1. Field of the Invention

The invention concerns coaxial cable, and more particularly, a method for manufacturing a coaxial cable.

2. Description of the Prior Art

A method for manufacturing a coaxial cable is known from German document No. DE-OS 16 40 194, wherein an aluminum band or strip is formed into a large diameter tube around a foam-insulated (dielectric material-insulated) conductor. The tube is welded with a lengthwise seam and is pulled down over the layer of dielectric material. A welding torch is used to weld the lengthwise edges of the tube. An advantage of a cable manufactured in this manner is that the fully closed outer tube is a conductor which prevents radiation losses. A disadvantage is that water can propagate in a gap between the dielectric material and the outer conductor, thereby diminishing the transmission properties of the cable. Such a gap cannot be avoided, although the dielectric material is slightly compressed when the outer conductor is pulled down over it.

A coaxial cable is known from U.S. Pat. No. 3,315,025, wherein an outer conductor comprises an aluminum or copper strip wrapped longitudinally, with overlapping edges, around a dielectric layer comprising foam material which surrounds an inner conductor. The aluminum or copper strip is coated with a copolymer coating. A relatively thick outer jacket of plastic material is extruded over the outer conductor and copolymer coating, with a wall thickness of between 1 and 3 mm. The copolymer coating is activated at the extrusion temperature of the outer jacket, and provides a good adhesive bonding between the outer conductor and the outer jacket. The overlapping edges of the strip are also adhesively bonded by the copolymer coating. This cable has a disadvantage in that the outer conductor does not form a self-closing sheath, therefore energy can escape through a slot between the overlapping edges of the band. This problem is aggravated by the fact that the overlapped seam may tear apart at increased temperatures. Since plastics have a higher coefficient of expansion than metals by a factor of 10, it is possible that the overlapping seam will rupture during a long-term exposure to a temperature of 50° C., for example. Another disadvantage is that the overlapped seam is copied on the jacket surface. Additionally, a lengthwise water migration along the cable cannot be avoided.

SUMMARY OF THE INVENTION

An object of the present invention is the provision of an improved coaxial cable having a thin metal outer conductor which prevents radiation losses from the coaxial cable and which is either adhesively attached to a dielectric material surrounding an inner conductor of the coaxial cable or to an outer jacket of the coaxial cable.

It has been found that the foregoing objects can be readily attained by providing a metal strip having a plastic layer on at least on one of its surfaces and welding a seam formed by lengthwise edges of the metal strip by laser welding, thereby forming a tubular shaped conductor.

It was an unexpected result that a plastic layer adhering to a metal strip has no adverse effect on the welding procedure and on the quality of the welded seam. Such a plastic layer permits the wall thickness of the outer conductor of a coaxial cable to be reduced, which could possibly lead to cost savings.

A focused laser beam is used for welding the seam. Such a laser beam concentrates the energy on a point (focal point), while significantly lower energy densities are found in front and behind the focal point, so that there is no impairment of the dielectric layer surrounded by the metal strip or tube.

After the seam is welded, the tubular shaped conductor is drawn down on the dielectric material and a plastic outer jacket is extruded over the welded tube, which is designed to protect the thin-walled, mechanically poorly stable outer conductor from damage.

A particularly advantageous configuration is obtained if an aluminum strip with a copolymer coating on one side is formed around the dielectric layer with the copolymer coating facing the dielectric layer. The subsequent extrusion of the outer jacket activates the copolymer coating at the extrusion temperature of the outer jacket and causes an internal adhesion between the dielectric layer and the outer conductor. A coaxial cable of this construction provides the significant advantage of being absolutely waterproof lengthwise. In addition, this construction is very stable. Because of the adhesion of the thin-walled outer conductor to both the dielectric layer and the outer jacket, bending the cable at the usual bending radii does not cause any tearing. It is of special advantage to use an aluminum band with a wall thickness of 0.15 to 0.25 mm and a copolymer coating thickness of 0.02 to 0.06 mm.

Ideally, during welding of the tube, any vapor originating during the welding process is vacuumed off. This prevents contamination of the laser lens.

Prior to welding of the tube, a strip of copolymer material may be inserted into the still open slotted tube in such a way, that it comes to rest under the lengthwise edges of the tube which form the welded seam. The copolymer strip will replace the copolymer coating that was destroyed in the welded seam area by the laser welding. The width of the copolymer strip depends on the width of the copolymer coating that was destroyed on the tube. It is useful if the copolymer strip is somewhat wider than the destroyed coating.

In a further development of the present invention, an improved method for producing a corrosion-protected corrugated metal tube is provided. The corrugated metal tube is manufactured from a lengthwise incoming metal strip by forming the metal strip into a tube having a lengthwise extending slot, and lengthwise welding the tube and subsequent corrugation of the welded tube. A plastic layer is provided on the outside surface of the metal tube to protect it against corrosion. The invention comprises a combination of the following features:

a) at least on the surface forming the outer surface of the metal tube, the metal strip is provided with a copolymer coating that adheres to the surface of the metal strip, b) the slotted tube is welded by laser welding, c) the copolymer coating is replaced in the welded seam area, d) the plastic-coated metal tube is continuously corrugated.

The essential advantage of the invention can be seen in that the layer forming the plastic jacket is not applied to a corrugated tube but to a flat metal band. The adhesion between the metal tube and the plastic jacket is thereby significantly improved. It was an unexpected result that the laser welding of the plastic coated metal strip into a tube only destroys a very limited area of the plastic coating, and that the plastic coating does not impair the corrugation process and is not destroyed during the corrugation. Additionally, no change in the wall thickness of the plastic jacket occurs during corrugation. Expensive band cleaning and large extruders, such as were needed before to extrude the plastic jacket, can now be omitted. Copolymers have the advantageous characteristic that they adhere very well to metal surfaces and also to plastic surfaces. It is therefore not absolutely necessary to produce the corrosion-protection coating entirely from a copolymer, but rather to select a coating construction of a copolymer and a suitable polyolefin, where the copolymer coating serves to provide the adhesion between the metal surface and the polyolefin coating. The coated metal strip required for the invention can simply be produced by laminating.

It is essential that the strength values required from the tube are supplied by the metal tube, the plastic coating only functions as a corrosion layer and in small measure also as a mechanically protective coating. Still, the sandwich construction makes it possible to reduce the metal tube wall thickness by about 10 to 20%. The plastic coating can also be made significantly thinner than the plastic jacket used until now. The method of the invention has a special advantage when applied to the manufacture of coaxial cables, where the outer conductor is manufactured in accordance with the invention.

The foregoing, and other objects, features and advantages of the present invention will become more apparent in light of the following detailed description of exemplary embodiments thereof.

DETAILED DESCRIPTION OF THE INVENTION

Figure 1:
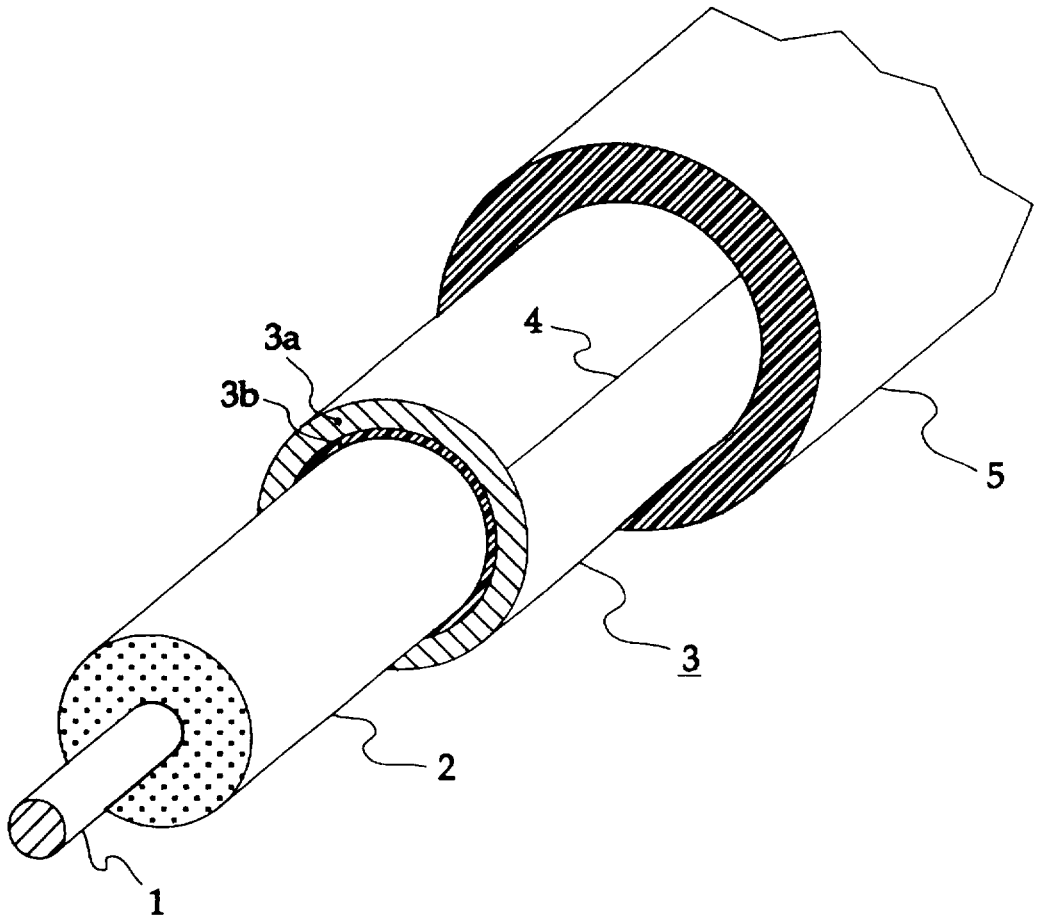
FIG. 1 is a perspective view, partially broken away, of a cable manufactured in accordance with the present invention.

The cable illustrated in FIG. 1 contains an inner conductor 1 made of copper or a copper-clad aluminum wire, a dielectric layer 2, e.g., of foamed polyethylene, an outer conductor 3 of aluminum and an outer jacket 5 made e.g. of polyethylene. The outer conductor 3 comprises a tube shaped aluminum strip 3*a* having a copolymer coating 3*b*. The aluminum strip may have a thickness of from 0.15 mm to 0.25 mm, for example, and the copolymer coating 3*b* may have a thickness of from 0.02 mm to 0.06 mm, for example. A welded seam 4 forms the tube-shaped outer conductor 3 from the copolymer-coated aluminum strip 3*a*, 3*b*. The copolymer coating 3*b* is on the side of the aluminum strip 3*a* adjacent to the dielectric layer 2 and bonds the outer conductor 3 to the dielectric layer 2. The inner conductor 1 is also bonded to the dielectric layer 2 to create a lengthwise waterproof cable. Adhesion between the outer conductor 3 and the outer jacket 5 can be advantageous for many applications, but is not required for electrical reasons.

Figure 2:
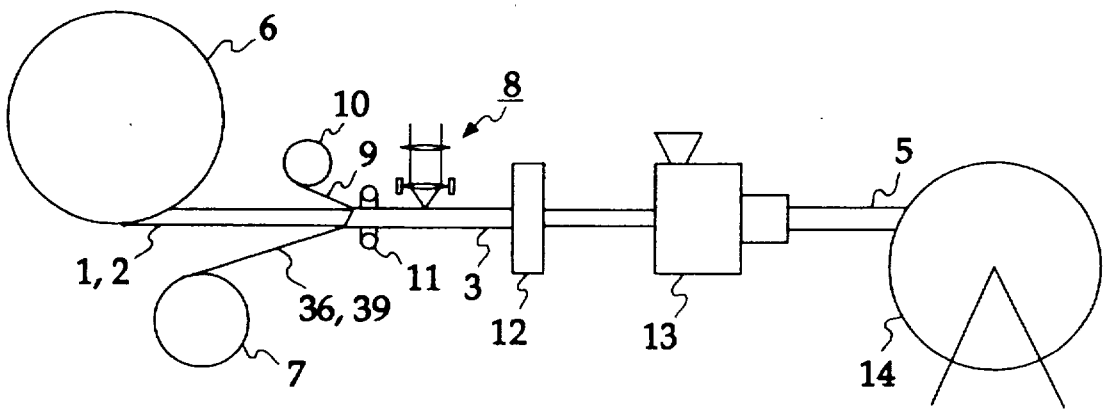
FIG. 2 is a schematic diagram of an apparatus used to manufacture the cable of FIG. 1.

The manufacture of such a cable will be explained in more detail with reference to FIG. 2. The inner conductor 1, which is supplied with the dielectric layer 2, is continuously drawn from a feed drum 6 and encased by the copolymer-coated aluminum band 3*a*, 3*b*, which is continuously drawn from a supply spool 7. The copolymer-coated aluminum strip 3*a*, 3*b* is formed into a tube with a larger inner diameter than the outer diameter of the dielectric layer 2, i.e. with a gap therebetween. The tube slot is continuously welded by a laser welding installation 8. When the tube that forms the outer conductor 3 is welded, the copolymer coating 3*b* on the inner surface of the tube is partially destroyed, in the area of welded seam 4 (FIG. 1). Therefore, prior to forming the welded seam 4 (FIG. 1), a strip 9 of a copolymer (FIG. 2) is drawn from a supply spool 10 and positioned on the dielectric layer 2, so that the strip is located under the welded seam 4 (FIG. 1). Vapors released when the copolymer coating 3*b* is partially destroyed during the welding process are removed by a vacuum installation 11. The welded tube is then drawn down, through a draw station 12, onto the surface of the dielectric layer 2, which is thereby slightly compressed. After that, the outer jacket 5 is extruded over the outer conductor 3 by an extruder 13. The extrusion heat activates the copolymer coating 3*b* and bonds the dielectric layer 2 to the aluminum layer 3*a*. At the same time, the copolymer strip 9 melts and "repairs" the welded seam 4 from underneath. The finished cable is then wound onto a drum 14, for example.

Another advantageous embodiment of the invention is explained in greater detail with reference to configuration examples schematically illustrated in FIGS. 3, 4 and 5.

Figure 3:
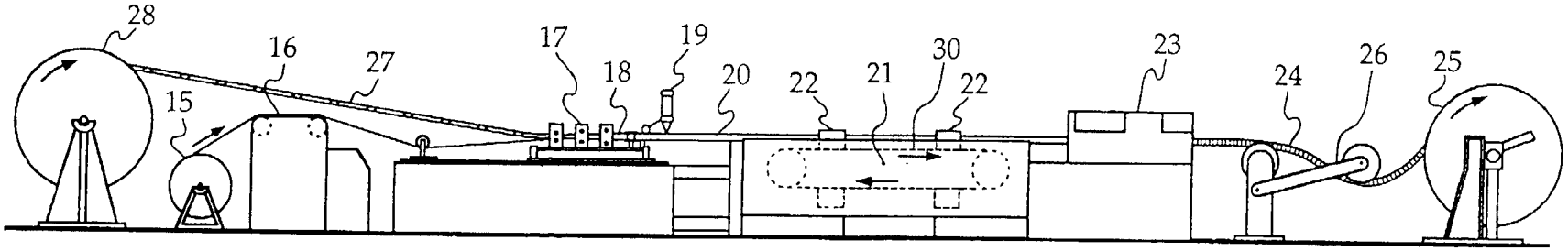
FIG. 3 is a more detailed schematic diagram of the apparatus of FIG. 2.

Referring to FIG. 3, plastic-coated metal strip 16 is continuously drawn from a supply spool 15, and formed into a tube 18 having a lengthwise slot by a forming device 17. The metal strip 16 is drawn from the supply spool 15 so that the plastic coating forms the outer surface of the tube 18.

Steel, high-grade steel, copper or aluminum are particularly useful materials for the metal strip 16. The plastic coating comprises of a copolymer, preferably a polyethylene copolymer. Copolymers adhere very well to metal surfaces. The plastic coating may comprise of a copolymer by itself, or of another suitable plastic material, where a thin copolymer coating is used as the adhesive layer between the metal surface and the plastic material. Polyethylene is considered an advantageous plastic material in the latter instance.

Behind the forming device 17, the tube 18 reaches a welding installation 19, wherein the lengthwise slot of the tube 18 is closed by welding. The welding installation is a laser welding installation 19, which produces a narrowly defined welded seam. The laser welding installation 19 is preferably a semiconductor laser, which is focused, where the focal point lies slightly above the welded seam. The laser welding installation 19 is configured so that the laser beam follows the course of the lengthwise slot in tube 18.

The plastic coating adjacent to the welded seam is destroyed as a result of the energy supplied by the laser. The width of the area wherein the plastic coating has been eliminated only measures about 1 to 2 mm. Depending on which metal is welded, at what speed the tube is drawn, where the focal point of the laser is located and which plastic material was used, the plastic material adjacent the damaged area either repairs the damaged area by itself while it is still liquid, or the damaged area must be closed by means of special measures. For example, a not illustrated narrow strip can be placed into the damaged area (in a manner similar to the first embodiment) and welded there. Alternatively, a bead of liquid plastic material can be inserted into the gap prior to welding.

The welded tube 20, equipped with a plastic coating, is gripped by a collet take-up device 21 comprising a number of collet pairs 22, which grip and release the tube 20 and are attached to an endless motorized chain 30. Behind the collet take-up device 21, the tube 20 reaches a corrugating device 23, in which the plastic coated tube wall is continuously worked to produce the corrugation. Such a corrugating device is described in German document No. DE-PS 10 86 314, for example. The corrugated tube 24 is then wound onto a take-off reel 25. A so-called dancer or a guide installation 26 provides for uniform winding speed and guides the tube 24 onto the reel 25.

If the corrugated tube 24 is used as the outer jacket of a high-frequency coaxial cable, a dielectrically coated inner conductor 27 is drawn from a supply spool 28 and placed on the metal band 16, which envelops the conductor 27 in the forming device 17.

Figure 4:
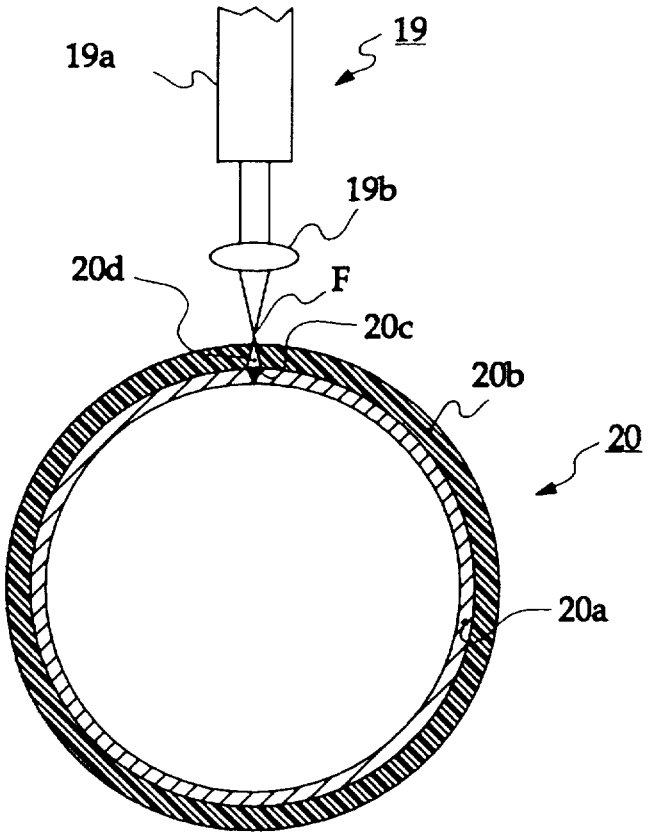
FIG. 4 is a schematic diagram of welding apparatus used to weld a seam of the cable of FIG. 1.

FIG. 4 illustrates a cross section of the welded tube 20 in the area of welding installation 19.

The tube 20 comprises a metal tube 20*a*, e.g. made of aluminum, and a plastic coating 20*b* which are securely attached to each other.

The laser welding installation 19 comprises the laser 19*a* and a lens 19*b*, which is adjusted so that the focal point F is positioned above the welded seam 20*c* of tube 20. The laser beam burns the plastic material above the welded seam 20*c*. The combustion products are removed by a not illustrated vacuum device. The narrow damaged area 20*d*, which the laser beam has produced in the plastic coating 20*b*, is repaired immediately behind the welding installation 19, i.e. is filled in by additionally supplied or the adjacent plastic material.

Figure 5:
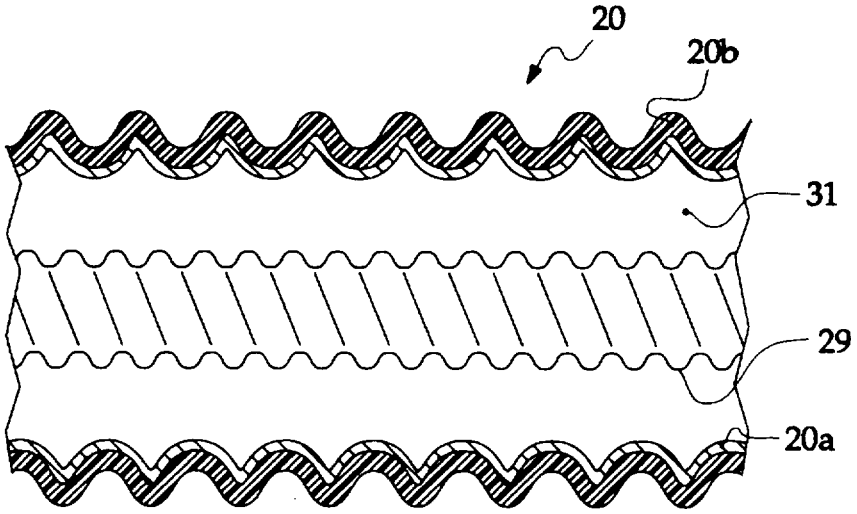
FIG. 5 is a lengthwise cross-sectional view of a corrugated cable manufactured in accordance with the present invention.

FIG. 5 illustrates a cross section of a coaxial cable made of two concentrically corrugated tubes. The inner tube 29 is not sectioned in this Figure. It can clearly be seen that the outer tube, comprising the metal tube 20*a* and a plastic coating 20*b*, is helically corrugated and the plastic coating 20*b* follows the corrugated metal tube wall because of its good adhesion to the metal tube 20*a*.

In a high-frequency coaxial cable of the type shown in FIG. 5, the inner tube 29 is kept concentric with the outer tube 20 by a layer of foam 31.

The following dimensions are given as an example:

Outside diameter of the outer tube 20=250 mm

Wall thickness of the outer tube metal 20*a*=0.9 mm

Wall thickness of the outer tube plastic 20*b*=3.0 mm

It is an advantage if the plastic coating 20*b* is cross-linked. This improves the abrasion resistance and other mechanical properties of the plastic. The cross-linkage can take place by cross-linking the band or even the plastic coating on the tube after welding.

The invention is described herein using a copolymer coating because copolymers have the advantageous characteristic that they adhere very well to metal surfaces and also to plastic surfaces. However, it is not absolutely necessary to produce the coating entirely from a copolymer, but rather a coating construction of a copolymer and a suitable polyolefin may be used in accordance with the invention, where the copolymer coating serves to provide adhesion between the metal surface and the polyolefin coating.

The foregoing, and other objects, features and advantages of the present invention will become more apparent in light of the following detailed description of exemplary embodiments thereof.

What is claimed is:

1. A method for manufacturing a coaxial cable, comprising the steps of:

providing an inner conductor;

extruding a dielectric layer over said inner conductor;

providing a lengthwise extending metal strip having a plastic coating on at least one of its surfaces;

forming said metal strip into a tube around said dielectric layer, said tube having a lengthwise extending slot defined by lengthwise edges of said strip;

laser welding said lengthwise edges of said strip together, thereby forming a lengthwise extending weld seam on said tube; and drawing said tube down onto said dielectric layer.

2. A method as claimed in claim 1, wherein said laser welding step includes the step of providing a focused laser beam having a focal point for laser welding said lengthwise edges of said strip together, an actual welding point being located under said focal point.

3. A method as claimed in claim 2, further comprising the step of extruding a plastic outer jacket over said welded tube after said welded tube is drawn down onto said dielectric layer.

4. A method as claimed in claim 2, wherein said lengthwise extending metal strip is aluminum and said plastic coating is a copolymer coating on one major surface thereof, and wherein said copolymer coating faces said dielectric layer.

5. A method as claimed in claim 1, wherein said metal strip has a wall thickness of from 0.15 mm to 0.25 mm, and wherein said plastic coating has a thickness of from 0.02 mm to 0.06 mm.

6. A method as claimed in claim 1, further comprising the step of vacuuming away vapor produced during said step of laser welding.

7. A method as claimed in claim 1, further comprising the step of inserting a copolymer strip in said lengthwise extending slot prior to laser welding, said copolymer strip being positioned under said welded seam after laser welding.

8. A method as claimed in claim 1, further comprising the step of extruding a plastic outer jacket over said welded tube after said welded tube is drawn down onto said dielectric layer.

9. A method as claimed in claim 1, wherein said lengthwise extending metal strip is aluminum and said plastic coating is a copolymer coating on a major surface thereof, and wherein said copolymer coating faces said dielectric layer.

10. A method as claimed in claim 1, wherein said plastic coating has an increased thickness in an area adjacent to said lengthwise extending slot, said increased thickness melting during laser welding and replacing any of said plastic coating in the area of said weld seam destroyed by laser welding.

11. A method for manufacturing a corrosion-protected corrugated metal tube, comprising the steps of:

providing a lengthwise extending metal strip having a copolymer coating on at least one major surface thereof;

forming said metal strip into a tube having a lengthwise extending slot defined by lengthwise edges of said metal strip, an outer surface of said tube having said copolymer coating thereon;

laser welding said lengthwise edges of said metal strip, thereby forming a lengthwise extending weld seam on said tube;

restoring an area of said copolymer coating adjacent said weld seam destroyed by the laser welding; and continuously corrugating said tube along its length.

12. A method as claimed in claim 11, further comprising the step of coating said copolymer coating with a polyolefin coating, said copolymer coating functioning as an adhesive coating between said tube and said polyolefin coating.

13. A method as claimed in claim 12, wherein said copolymer is a polyethylene copolymer and wherein said polyolefin is a polyethylene.

14. A method as claimed in claim 12, further comprising the steps of:

providing said polyolefin coating with an increased wall thickness in the area of said lengthwise edges; and wherein said step of restoring is performed by melting said increased wall thickness during laser welding, whereby said melted increased wall thickness flows into said polyolefin adjacent said weld seam.

15. A method as claimed in claim 12, wherein the step of restoring includes the steps of:

inserting a strip of polyolefin and copolymer adjacent the destroyed area of said polyolefin coating produced by laser welding; and attaching said strip to the destroyed areas of said polyolefin coating.

16. A method as claimed in claim 11, further comprising the step of cross-linking said copolymer coating and said polyolefin coating.

17. A method as claimed in claim 11, further comprising the steps of:

providing said copolymer coating with an increased wall thickness in the area of said lengthwise edges; and wherein said step of restoring is performed by melting said increased wall thickness during laser welding, whereby said melted increased wall thickness flows into the destroyed area of said copolymer coating adjacent said welded seam.

18. A method as claimed in claim 11, further comprising the steps of:

inserting a strip of copolymer adjacent the destroyed area of said copolymer coating produced by laser welding; and attaching said strip of copolymer to the destroyed area of said copolymer coating.

19. A method as claimed in claim 11, further comprising the step of cross-linking said copolymer coating.

20. A method as claimed in claim 11, wherein prior to said step of laser welding, the following step of:

providing an inner conductor; and extruding a dielectric layer over said inner conductor are performed; and said metal strip being formed into a tube around said dielectric layer;

wherein after said step of laser welding, the step of continuously corrugating said tube along its length is performed.

21. A method as claimed in claim 20, wherein said inner conductor is a corrugated metal tube, and wherein said dielectric layer is a layer of foam for maintaining said inner conductor concentric with said tube.

* * * * *